US005471960A

United States Patent [19]

Nagao et al.

[11] Patent Number: 5,471,960

[45] Date of Patent: Dec. 5, 1995

[54] CYLINDER FOR TWO-CYCLE INTERNAL COMBUSTION ENGINE

[75] Inventors: Yoshiaki Nagao, Fussa; Kazuhiro Tsutsui, Hachiohji, both of Japan

[73] Assignee: Kioritz Corporation, Ohme, Japan

[21] Appl. No.: 376,658

[22] Filed: Jan. 20, 1995

Related U.S. Application Data

[63] Continuation of Ser. No. 132,915, Oct. 7, 1993, abandoned.

[30] Foreign Application Priority Data

Oct. 8, 1992 [JP] Japan ..... 4-070271 U

[51] Int. Cl.[6] ..... F02B 25/16; F02F 1/22

[52] U.S. Cl. ..... 123/65 A; 123/65 P

[58] Field of Search ..... 123/65 A, 65 W, 123/65 P, 65 PE, 193.2, 193.4, 65 PD, 65 E, 73 A, 41.7

[56] References Cited

U.S. PATENT DOCUMENTS

| | | | |
|---|---|---|---|
| 2,115,657 | 4/1938 | Venediger | 123/65 A |
| 2,189,357 | 2/1940 | Cull | 123/65 A |
| 3,752,129 | 8/1973 | Kobayashi et al. | 123/73 A |
| 3,844,334 | 10/1974 | Frederickson . | |
| 4,233,717 | 11/1980 | Noda et al. | 123/65 A |
| 4,340,016 | 7/1982 | Ehrlich | 123/65 A |
| 4,671,219 | 6/1987 | Ooyama et al. | 123/65 A |
| 4,765,282 | 8/1988 | Nagashima | 123/41.7 |
| 5,040,496 | 8/1991 | Plohberger et al. | 123/65 W |
| 5,213,069 | 5/1993 | Curtil | 123/65 A |
| 5,251,580 | 10/1993 | Torigai | 123/69 PD |

FOREIGN PATENT DOCUMENTS

| | | | |
|---|---|---|---|
| 0590331 | 1/1934 | Germany | 123/65 A |
| 40-4885 | 2/1965 | Japan . | |
| 47-4207 | 9/1972 | Japan . | |
| 54-26423 | 8/1979 | Japan . | |
| 56-92732 | 7/1981 | Japan . | |
| 57-53026 | 3/1982 | Japan . | |
| 216034 | 5/1990 | Japan . | |

*Primary Examiner*—Marguerite Macy
*Attorney, Agent, or Firm*—Cushman, Darby & Cushman

[57] ABSTRACT

A cylinder for a two-cycle internal combustion engine is disclosed which enables reduction of HC in exhaust gas to be effectively attained without any complicated modification. A pair of scavenging ports 20, 20 are oppositely formed which employ loop scavenging mode towards the direction opposite to an exhaust port 16 symmetrically with respect to the longitudinal section F bisecting the exhaust port 16. A pocket portion 20*c* is formed at the innermost end of the inner surface 20*a* of the end portion closer to the exhaust port 16 of each of the scavenging ports 20, 20 to form a prolonged wall portion 20*d* extending along the inner wall surface 5 of the cylinder 1 in the direction apart from the exhaust port 16.*b*

2 Claims, 2 Drawing Sheets

CYLINDER FOR TWO-CYCLE INTERNAL COMBUSTION ENGINE

This is a continuation of application Ser. No. 08/132,915, filed on Oct. 7, 1993, which was abandoned upon the filing hereof.

BACKGROUND OF THE INVENTION

1. Field of the Invention

The present invention relates to, for example, cylinders suitable for relatively small two-cycle internal combustion engines which are used for portable machines and the like. In particular, it relates to those optimized in horizontal scavenging angle (collision angle) of fresh gas mixture (air-fuel mixture) blown off from a pair of scavenging ports employing loop scavenging mode to reduce noxious substances in exhaust gas.

2. Description of the Prior Art

Exhaust gas regarded as a principal cause of air pollution is mostly exhausted from boilers used in factories and internal combustion engines mounted on automobiles. Various attempts have been made to take measures for reducing noxious substances contained in such exhaust gas, i.e., NOx (substances resulting from combustion of fuel), CO (substance resulting from incomplete combustion of fuel), HC (substance of unburnt combustible from fuel), and the like.

On the other hand, there has heretofore been taken minor account of relatively small (total displacement is about 35 cc or less) general purpose two-cycle gasoline engines which are used for portable machines and the like because of their small displacement. Recently, however, under increasing tendency to grapple with environmental problems, it is strongly demanded also with respect to such small two-cycle gasoline engines to reduce noxious substances in exhaust gas discharged therefrom.

FIGS. 2 and 3 show one illustrative form of a cylinder of a conventional small air-cooled two-cycle gasoline engine, for which it is urgently needed to reduce noxious substances in exhaust gas, (in FIG. 2, the ports are depicted as if all of them were in the same level for the convenience of explanation).

The cylinder 50 comprises a cylinder portion 2 having a cylindrical inner wall 5 into which a piston is fit-inserted and a head portion 3 formed with a combustion chamber 7 of so-called squish dome type, which are integrally formed with each other, and is formed with a plurality of cooling fins 12 at its peripheral portion. In the cylinder portion 2, an intake port 14 and an exhaust port 16 are so formed as to open oppositely at different levels, and a pair of scavenging ports 20, 20 are oppositely formed which employ Loop scavenging mode (Schneule scavenging mode) symmetrical with respect to the longitudinal section F bisecting the exhaust port 16 (the vertical plane passing along the axis CL of the cylinder 50).

In this form, inner horizontal scavenging angle $\alpha$ is right angle which is formed by extension lines from inner surfaces 20*a*, 20*a* of end potions closer to the exhaust port 16 of the pair of scavenging ports 20, 20, and the intersection Q of the pair of outer horizontal scavenging lines c, d, which are extension lines from inner surfaces 20*b*, 20*b* of end portions farther from the exhaust port 16, is arranged to be located on the inner wall surface 5 of the cylinder, and the distance g along the inner wall surface 5 of the cylinder between each of the ends of the inner wall of the exhaust port 16 and the end of the inner surface 20*a* of each of the scavenging ports 20, 20 is relatively short.

In such a conventional small two-cycle engine using gasoline as fuel as described above, of noxious substances contained in exhaust gas discharged therefrom, there is prospect of reduction of NOx and CO to some extent by optimizing air/fuel ratio or the like. As things stand, however, there have not been found effective measures for reducing HC discharged due to blow-by phenomenon of unburnt air-fuel mixture (fresh gas mixture) inherent in a so-called piston valve type engine.

SUMMARY OF THE INVENTION

In view of these points, it is an object of the present invention to provide a cylinder for a two-cycle internal combustion engine which is capable of effectively reducing HC in exhaust gas by preventing blow-by of fresh gas mixture without complicated modification.

The present inventors have made intensive and extensive studies focusing their attention on exhaust ports of small general purpose two-cycle engines, and as a result, they have found that the above object can be attained by modifying a distance g between the exhaust port 16 and the scavenging port 20 from conventional one to optimum one.

The cylinder of the two-cycle engine according to the present invention has been completed on the basis of the results of the studies and trial production founded thereon, and its specific structure is characterized in that a pair of scavenging ports 20, 20 are oppositely formed which employ loop scavenging mode toward the direction opposite to an exhaust port 16 symmetrically with respect to the longitudinal section F bisecting the exhaust port 16, and a pocket portion 20*c* is formed at the innermost end of the inner surface 20*a* of the end portion closer to the exhaust port 16 of each of the scavenging ports 20, 20 to form a prolonged wall portion 20*d* extending along the inner wall surface 5 of the cylinder in the direction apart from the exhaust port 16.

In the cylinder for the two-cycle internal combustion engine according to the present invention which is constructed as described above, the horizontal scavenging angle of the pair of right and left scavenging ports is sharp as compared with conventional one, and hence the confluence of streams of fresh gas mixture blown off from the pair of right and left scavenging ports is substantially more distant from the exhaust port.

Consequently, short-circuit of the fresh gas mixture to the exhaust port is inhibited, in other words, the amount of discharged air-fuel mixture remaining unburnt which is so-called blow-by loss is reduced. Accordingly, the amount of HC which is an unburnt combustible in exhaust gas discharged from the exhaust port is remarkably reduced.

In this invention, since the blow-by loss of the air-fuel mixture is reduced, output characteristics is improved, and fuel saving is realized. Further, these are attained by virtue only of the simple modification of the shape of the scavenging port, thereby leading to no substantial increase in cost.

DESCRIPTION OF THE PREFERRED EMBODIMENT

Now, an embodiment of the present invention will be described in detail with reference to the accompanying drawings.

Figure 1:
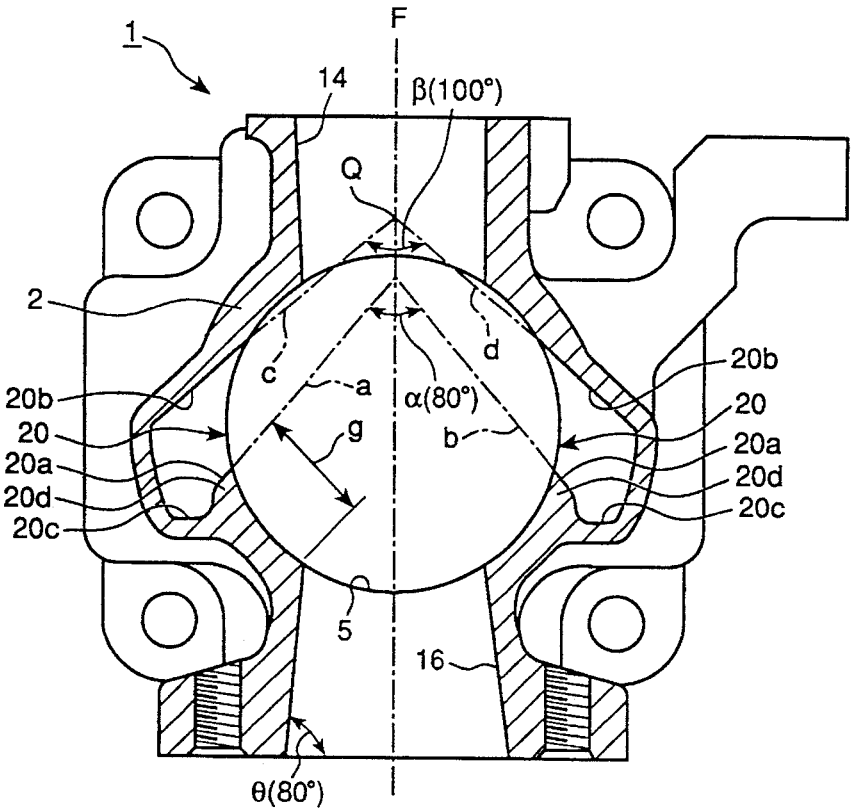
FIG. 1 is a horizontal sectional view of one embodiment of the cylinder for the two-cycle internal combustion engine according to the present invention.
Figure 2:
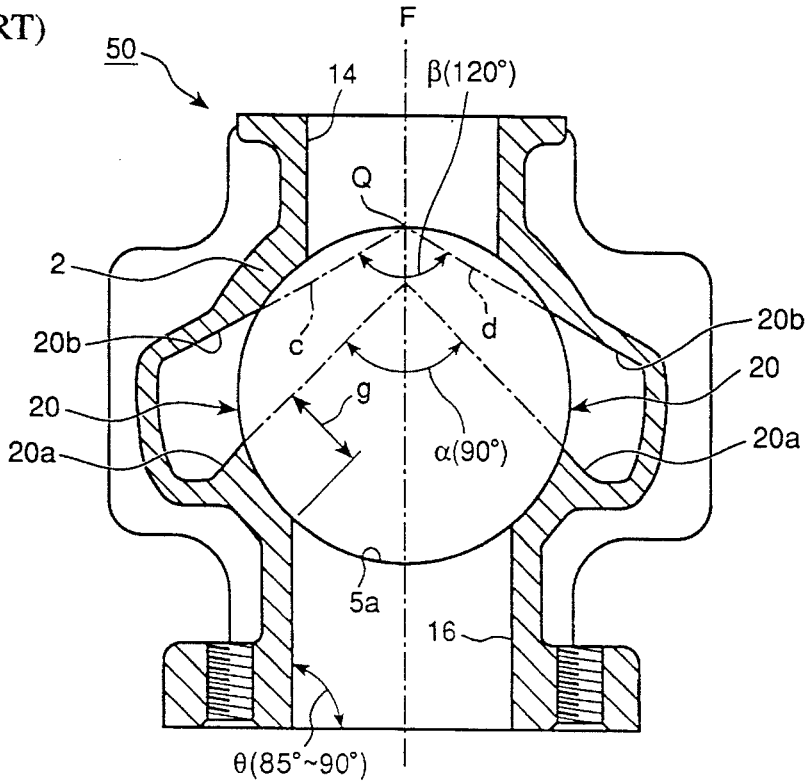
Fig. 2 (PRIOR ART)
FIG. 2 is a horizontal sectional view showing one form of a conventional cylinder for a two-cycle internal combustion engine.
Figure 3:
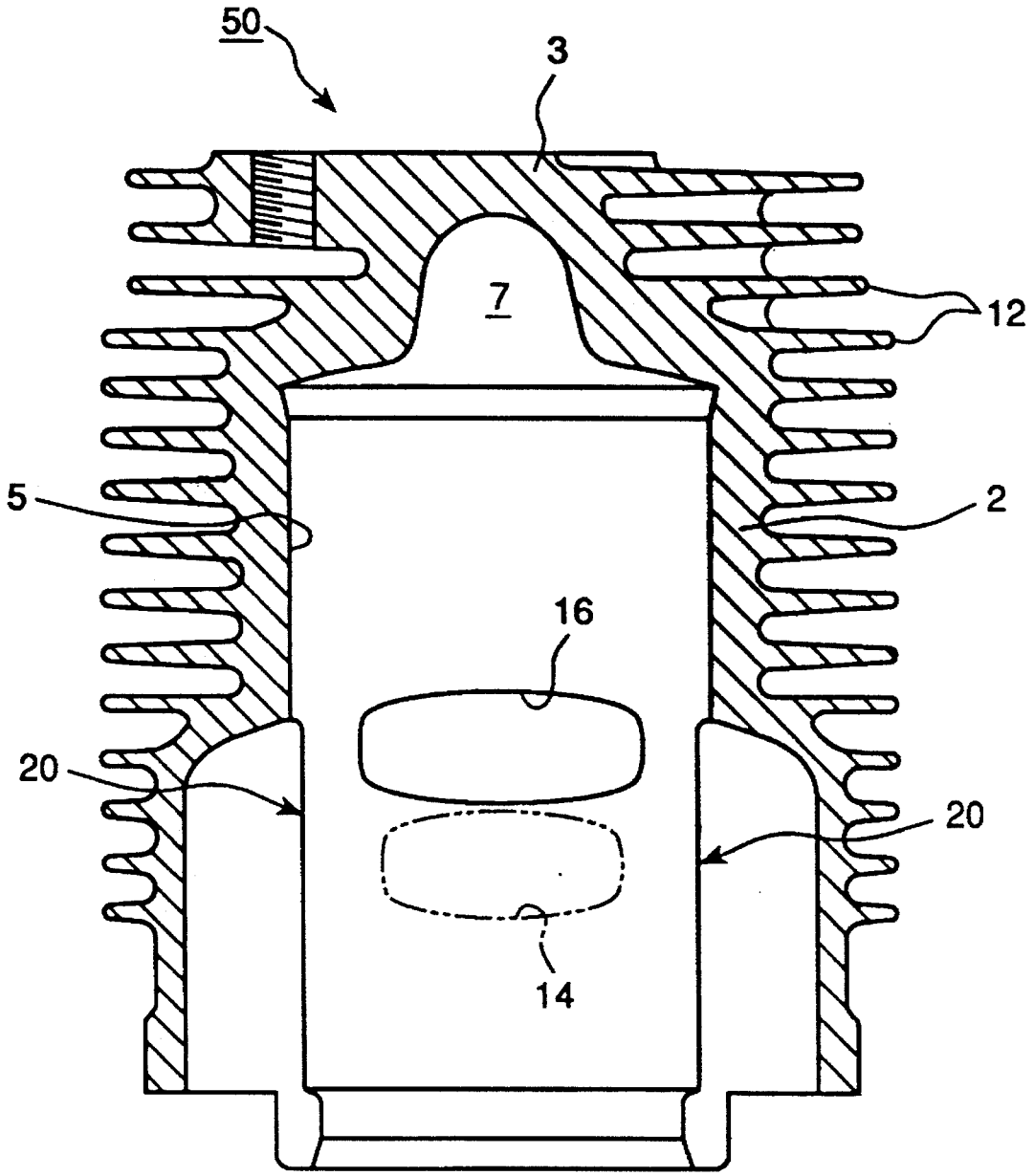
Fig. 3 (PRIOR ART)
FIG. 3 is a vertical sectional view showing one form of a conventional cylinder.

FIG. 1 shows one embodiment of the cylinder for the two-cycle internal combustion engine according to the present invention (in FIG. 1, the ports are depicted as if all of them were in the same level for the convenience of explanation). In this embodiment, the same reference numbers are allotted to the parts as allotted to the corresponding parts of the above-described conventional cylinder 50 shown in FIGS. 2 and 3 to eliminate overlapping explanation, and differences will be described principally hereinbelow.

In the cylinder 1 shown in FIG. 1, which is one embodiment of the present invention, a pair of scavenging ports 20, 20 employing a loop scavenging mode (Schneule scavenging mode) are oppositely formed in such a manner that they are symmetrical with respect to the longitudinal section F bisecting the exhaust port 16 and passing along the axis CL of the cylinder 1. The pair of scavenging ports 20, 20 are different from the conventional counterparts in shape, and other parts such as a combustion chamber have substantially the same structures as those of the conventional counterparts.

In the cylinder 1 of this embodiment, each of the pair of scavenging ports 20, 20 is provided with a prolonged wall portion 20*d*, and inner horizontal scavenging angle $\alpha$ is an acute angle (80°, in this case) which is the intersectional angle of a pair of inner horizontal scavenging lines a, b formed by the inner surfaces 20*a*, 20*a* of end potions closer to the exhaust port 16 and which is right angle in a conventional cylinder. Further, outer scavenging angle $\beta$ is reduced from conventional about 120° to about 100° which is the intersectional angle of a pair of outer horizontal scavenging lines c, d formed by inner surfaces 20*b*, 20*b* of end portions farther from the exhaust port 16, so that the intersection Q of the outer horizontal scavenging lines c,d, which has conventionally been arranged to be located on the inner wall surface 5 of the cylinder, is arranged to be located outside the inner wall surface of the cylinder. As a result, the scavenging air (fresh gas mixture) is directed toward the area more distant from of the exhaust port 16.

Incidentally, the intersection of the inner horizontal scavenging lines a, b and the intersection Q of the outer horizontal scavenging lines c, d are located on the longitudinal section F.

In the cylinder 1 of this embodiment, as shown in FIG. 1, the intersectional angle $\theta$ is narrowed from conventional 85°–90° to about 80°, which is formed by the inner wall surface of the exhaust port 16 and the plane perpendicular to the longitudinal section F. Further, a pocket portion 20*c* is formed at the innermost end of the inner surface 20*a* of the end portion closer to the exhaust port 16 of each of the scavenging ports 20, 20, so that the distance g along the inner wall surface 5 of the cylinder 1 between each of the ends of the inner wall of the exhaust port 16 and the end of the inner wall surface 20*a* of each of the scavenging ports 20, 20 is prolonged as compared with a conventional one. By the formation of the pocket portions 20*c*, 20*c*, directivity for the scavenging air-fuel mixture is improved, and throttling effect is exhibited on the blown off scavenging air-fuel mixture.

In the cylinder 1 of this embodiment, which has the above-described structure, the positions of openings of the scavenging ports 20, 20 are more distant from the exhaust port 16, and the horizontal scavenging angle formed by the right and left scavenging ports as a pair is sharp as compared with conventional one, and as a result, the confluence of streams of fresh gas mixture blown off from the pair of right and left scavenging ports 20, 20 is substantially more distant from the exhaust port 16.

Consequently, short-circuit of the fresh gas mixture to the exhaust port 16 is inhibited, in other words, the amount of discharged air-fuel mixture remaining unburnt which is so-called blow-by loss is reduced. Accordingly, the amount of HC which is an unburnt combustible in exhaust gas discharged from the exhaust port 16 is remarkably reduced.

In this invention, since the blow-by loss of the air-fuel mixture is reduced, output characteristics is improved. Further, this is attained by virtue only of the simple modification of the shape of the scavenging ports 20, 20, thereby leading to no substantial increase in cost.

When the present inventors actually produced a cylinder 1 (total displacement: 25 cc) by way of trial which has scavenging ports 20, 20 having a configuration as shown in FIG. 1 and experimental operation was carried out, it was confirmed that, by virtue only of such modification of the configuration of the scavenging ports, total amount of HC was remarkably reduced (by 30% or more) as compared with the case where the conventional cylinder 50 was used, and yet, output higher than that obtained by the conventional cylinder 50 was ensured.

As is understood from the above description, according to the cylinder for the two-cycle internal combustion engine of the present invention, there is obtained excellent effect that reduction of HC in exhaust gas can effectively be attained without complicated modifications.

What is claimed is:

1. A cylinder for a two-cycle internal combustion engine comprising:

a pair of scavenging ports formed on opposite sides of an inner surface of said cylinder which discharge an air-fuel mixture in a direction away from an exhaust port formed on said inner surface between said scavenging ports and which are symmetrical with respect to a longitudinal section bisecting the exhaust port, and a pocket portion formed at an inner end of an inner surface of each of the scavenging ports closest to said exhaust port, wherein each of the inner surfaces aligns with an inner horizontal scavenging line and each of said pocket portions includes a radiused area recessed away from said scavenging line in a direction towards said exhaust port.

2. The cylinder according to claim 1, wherein said scavenging lines are disposed so as to form an angle of approximately 80 degrees therebetween.

* * * * *